US010548353B2

(12) United States Patent
Toratani

(10) Patent No.: US 10,548,353 B2
(45) **Date of Patent: *Feb. 4, 2020**

(54) CLOTHING SUCH AS SHORTS

(75) Inventor: Ikuo Toratani, Kahoku (JP)

(73) Assignee: TORATANI CO., LTD., Kahoku-Shi (JP)

( * ) Notice: Subject to any disclaimer, the term of this patent is extended or adjusted under 35 U.S.C. 154(b) by 1479 days.

This patent is subject to a terminal disclaimer.

(21) Appl. No.: 13/219,785

(22) Filed: Aug. 29, 2011

(65) Prior Publication Data

US 2012/0324629 A1 Dec. 27, 2012

(30) Foreign Application Priority Data

Jun. 22, 2011 (JP) ..... 2011-138776

(51) Int. Cl.
*A41B 9/00* (2006.01)
*A41B 9/02* (2006.01)
*A41C 1/00* (2006.01)

(52) U.S. Cl.
CPC ..... *A41B 9/001* (2013.01); *A41C 1/003* (2013.01)

(58) Field of Classification Search
CPC .. A41D 7/005; A41B 9/00; A41B 9/02; A41B 9/04; A41B 9/004; A41B 9/001; A41B 9/12; A41B 2400/38; A41B 2400/52; A41B 2500/10; A41C 1/003
USPC ..... 2/400–407
See application file for complete search history.

(56) References Cited

U.S. PATENT DOCUMENTS 3,491,763 A * 1/1970 Blanchet ..... 450/104
3,496,576 A * 2/1970 Artzt ..... 2/402
3,591,865 A * 7/1971 Senser ..... 2/402
3,654,634 A * 4/1972 Torres ..... 2/403
4,205,397 A * 6/1980 Bechis ..... 2/67
4,538,615 A * 9/1985 Pundyk ..... A41C 1/003 450/131
4,984,304 A * 1/1991 Brown ..... A41C 1/003 2/400
5,888,118 A * 3/1999 Kishi ..... A41C 1/003 2/243.1

(Continued)

FOREIGN PATENT DOCUMENTS

EP 625316 A1 * 11/1994 ..... A41B 9/02
JP 57-205501 A 12/1982

(Continued)

*Primary Examiner* — Jameson D Collier
(74) *Attorney, Agent, or Firm* — Rankin, Hill & Clark LLP

(57) ABSTRACT

Clothing such as shorts is provided which is capable of fitting to the lower region of the hips of a person and preventing hip hemlines thereof from rising. The clothing includes a stretchable front covering portion and a stretchable back covering portion. A gusset portion disposed between an inner-crotch front portion at the lower end of the front covering portion and an inner-crotch back portion at the lower end of the back covering portion covers the crotch of the person. A body is opened and developed along a back center line of the back covering portion, and in the developed body, with respect to a front center line of the front covering portion, the back center line of the back covering portion is set so that the downward extended line of the back center line approaches the downward extended line of the front center line in a downward narrowing manner.

20 Claims, 11 Drawing Sheets

(56) References Cited

U.S. PATENT DOCUMENTS

| | | | | |
|---|---|---|---|---|
| 6,393,621 | B1 * | 5/2002 | Redwine | A41B 9/004 2/400 |
| 6,807,685 | B1 * | 10/2004 | Hasegawa | A41B 9/004 2/400 |
| 7,669,248 | B2 * | 3/2010 | Toratani | 2/67 |
| 2003/0217407 | A1 * | 11/2003 | Andrews-Jones | 2/400 |
| 2009/0077720 | A1 * | 3/2009 | Shinomiya | A41B 9/001 2/401 |
| 2012/0124716 | A1 * | 5/2012 | Toratani | 2/228 |
| 2014/0041097 | A1 * | 2/2014 | Toratani | 2/228 |

FOREIGN PATENT DOCUMENTS

| | | | | |
|---|---|---|---|---|
| JP | 7-207502 | A | 8/1995 | |
| JP | 11347067 | A | 12/1999 | |
| JP | 2000325396 | A | 11/2000 | |
| WO | WO 9623426 | A1 * | 8/1996 | A41B 9/04 |

* cited by examiner

CLOTHING SUCH AS SHORTS

TECHNICAL FIELD

The present invention relates to clothing such as shorts, pants, a bathing suit, a leotard, briefs, men's tights and ladies' tights, more specifically, clothing such as shorts which is particularly capable of fitting well to the shape of the bulgy buttocks in the lower region of the hips of a person, preventing hip hemlines thereof from rising when the person is walking or is in a crouching posture or the like, and improving the wearing feeling.

BACKGROUND ART

Since the hips are bigger than the waist in the body shape of a person, conventionally, clothing such as shorts of this type is formed by means of patterning (a cutting method) which generally makes the girth of the hips bigger than that of the waist. Specifically, in clothing such as shorts shown in developed form, for example, as shown in FIGS. 8 to 11, with respect to a front center line S1 vertically running through the middle in the lateral directions of a front covering portion (front body) 1, a back center line S2 vertically running through the middle in the lateral directions of a back covering portion (back body) 2 is set so that the downward extended line of the back center line S2 goes away gradually from the downward extended line of the front centerline S1 in a downward spreading manner (e.g., refer to Patent Documents 1 to 4). In each of FIGS. 8 to 11, reference numeral 3 denotes a gusset portion disposed between an inner-crotch front portion at the lower end of the front covering portion 1 and an inner-crotch back portion at the lower end of the back covering portion 2. FIG. 8 is a development plan view of a front body 1, a back body 2 and a gusset portion 3 of panties of Patent Document 1, FIG. 9 is a development plan view of a front body 1, a back body 2 and a gusset portion 3 of shorts of Patent Document 2, FIG. 10 is a development plan view of a front body 1, a back body 2 and a gusset portion 3 of shorts of Patent Document 3 and FIG. 11 is a development plan view of a body in which a front body 1 is united at the left and right edges thereof with a left half 2*a* and a right half 2*b* of a back body respectively of shorts of Patent Document 4.

Patent Document 1 is Japanese Patent Laid-Open Publication No. 57-205501 (FIG. 1), Patent Document 2 is Japanese Patent Laid-Open Publication No. 7-207502 (FIG. 3), Patent Document 3 is Japanese Patent Laid-Open Publication No. 2000-325396 (FIG. 1) and Patent Document 4 is Japanese Patent Laid-Open Publication No. 11-347067 (FIG. 3).

It is certain that the buttock top parts are large in the shape of the hips, and hence, up to the buttock top portion of clothing such as shorts corresponding to the buttock top part, as described above, the back center line S2 of the back covering portion (back body) 2 can also be set to spread downward with respect to the front center line S1 of the front covering portion (front body) 1. However, in the shape of the hips, the lower region of the hips (the shape of the bulgy buttocks in the lower region of the hips) approximates to the shape of the lower half of a sphere, and hence, when the back center line S2 of the back covering portion (back body) 2 is downward spread with respect to the front center line S1 of the front covering portion (front body) 1, the corresponding hip lower portion of clothing such as shorts to the hip lower region does not fit well to the hip lower region. Therefore, when a person changes from a standing posture and sits on a chair, bends at the waist or takes a crouching posture or the like, a hip hemline (a substantially rear half of the inner periphery of each of leg openings) is raised, and when the person is in a standing posture, loose wrinkles or bagginess is easily produced in the portion of clothing such as shorts corresponding to the hip lower region or the gluteal groove part.

DISCLOSURE OF INVENTION

The invention has been conducted in order to solve the problems. It is an object of the invention to provide clothing such as shorts which is capable of fitting excellently to the lower region of the hips of a person and certainly preventing hip hemlines thereof from rising.

The clothing such as shorts of the invention will be described, as set forth in a first aspect of the invention, with reference to the characters and numerals given to FIGS. 1 to 3 for the purpose of making the contents of the invention easily understandable.

The clothing such as shorts is characterized by including: a body (14) including a stretchable front covering portion (11) covering the lower abdomen of a person and a stretchable back covering portion (12) covering the buttocks of the person, the front covering portion (11) being formed at the lower end thereof with high-thigh-size formation portions (15) which are bilaterally symmetrical and each coved upward; and a gusset portion (13) disposed between an inner-crotch front portion (16) at the lower end of the front covering portion (11) and an inner-crotch back portion (17) at the lower end of the back covering portion (12) and covering the crotch of the person, and in that: the body (14) has the left half and the right half of the back covering portion (12) on both left and right sides respectively of the front covering portion (11) and is formed into a tubular shape by sewing together the left edge of the left half of the back covering portion (12) and the right edge of the right half of the back covering portion (12); and the body (14) is opened and developed along a back center line (S2) vertically running through the middle in the lateral directions of the back covering portion (12), and in the developed body (14), with respect to a front center line (S1) vertically running through the middle in the lateral directions of the front covering portion (11), the back center line (S2) of the back covering portion (12) is set so that the downward extended line of the back center line (S2) approaches the downward extended line of the front center line (S1) in a downward narrowing manner.

The clothing such as shorts of the invention will be described, as set forth in a second aspect of the invention, with reference to the characters and numerals given to FIGS. 1 to 3 for the purpose of making the contents of the invention easily understandable.

The clothing such as shorts is characterized by including: a tubular body (14) including a stretchable front covering portion (11) covering the lower abdomen of a person and a stretchable back covering portion (12) covering the buttocks of the person, the front covering portion (11) being formed at the lower end thereof with high-thigh-size formation portions (15) which are bilaterally symmetrical and each coved upward; and a gusset portion (13) disposed between an inner-crotch front portion (16) at the lower end of the front covering portion (11) and an inner-crotch back portion (17) at the lower end of the back covering portion (12) and covering the crotch of the person, and in that: the body (14) is sewn at least at one place (S1, X1, X2, Y1, Y2) in the peripheral directions thereof, in addition to the place of a back center line (S2) vertically running through the middle in the lateral directions of the back covering portion (12); and the body (14) is opened and developed along the back center line (S2) of the back covering portion (12), and in the developed body (14), with respect to a front center line (S1) vertically running through the middle in the lateral directions of the front covering portion (11), the back center line (S2) of the back covering portion (12) is set so that the downward extended line of the back center line (S2) approaches the downward extended line of the front center line (S1) in a downward narrowing manner.

Furthermore, the clothing such as shorts of the invention will be described, as set forth in a third aspect of the invention, with reference to the characters and numerals given to FIGS. 4 to 6 for the purpose of making the contents of the invention easily understandable.

The clothing such as shorts is characterized by including: a body (14) including a stretchable front covering portion (11) covering the lower abdomen of a person and a stretchable back covering portion (12) covering the buttocks of the person, the front covering portion (11) being formed at the lower end thereof with high-thigh-size formation portions (15) which are bilaterally symmetrical and each coved upward; and a gusset portion (13) disposed between an inner-crotch front portion (16) at the lower end of the front covering portion (11) and an inner-crotch back portion (17) at the lower end of the back covering portion (12) and covering the crotch of the person, and in that: the body (14) is formed into a tubular shape by uniting the back covering portion (12) continuously with the front covering portion (11) on both left and right sides of the front covering portion (11); and the body (14) is opened and developed along a back center line (S2) vertically running through the middle in the lateral directions of the back covering portion (12), and in the developed body (14), with respect to a front center line (S1) vertically running through the middle in the lateral directions of the front covering portion (11), the back center line (S2) of the back covering portion (12) is set so that the downward extended line of the back center line (S2) approaches the downward extended line of the front center line (S1) in a downward narrowing manner.

Moreover, the clothing such as shorts of the invention will be described, as set forth in a fourth aspect of the invention, with reference to the characters and numerals given to FIG. 7 for the purpose of making the contents of the invention easily understandable.

The clothing such as shorts is characterized by including: a tubular body (14) including a stretchable front covering portion (11) covering the lower abdomen of a person and a stretchable back covering portion (12) covering the buttocks of the person, the front covering portion (11) being formed at the lower end thereof with high-thigh-size formation portions (15) which are bilaterally symmetrical and each coved upward; and a gusset portion (13) disposed between an inner-crotch front portion (16) at the lower end of the front covering portion (11) and an inner-crotch back portion (17) at the lower end of the back covering portion (12) and covering the crotch of the person, and in that: the body (14) is sewn in at least one place (S1, X1, X2, Y1, Y2) in the peripheral directions thereof which is other than a back center line (S2) vertically running through the middle in the lateral directions of the back covering portion (12); and the body (14) is opened and developed along the back center line (S2) of the back covering portion (12), and in the developed body (14), with respect to a front center line (S1) vertically running through the middle in the lateral directions of the front covering portion (11), the back center line (S2) of the back covering portion (12) is set so that the downward extended line of the back center line (S2) approaches the downward extended line of the front center line (S1) in a downward narrowing manner.

According to the above configurations, the tubular body (14) is opened and developed along the back center line (S2) vertically running through the middle in the lateral directions of the back covering portion (12), and in the developed body (14), with respect to the front center line (S1) of the front covering portion (11), the back center line (S2) of the back covering portion (12) is set so that the downward extended line of the back center line (S2) approaches the downward extended line of the front center line (S1) in a downward narrowing manner. Therefore, the girth of the portion of the clothing such as shorts corresponding to the hip lower region is narrowed down so that the hip lower portion can fit to the shape of the hip lower region. Hence, the hip lower portion fits to the hemispherical lower half in the hip lower region, or more specifically, the lower portion of the back covering portion (12) fits perfectly to the shape of the bulgy buttocks in the hip lower region so as to envelop the lower half deeply in a squeezing manner. Furthermore, when the person is in a standing posture, neither loose wrinkles nor bagginess is produced in the portion of clothing such as shorts corresponding to the hip lower region or the gluteal groove part, thereby obtaining beautiful hip hemlines. In addition, as is obvious from the description of the configurations of the first to fourth aspects, in forming the body (14) into a tubular shape, the number of sewing places, the position of sewing, the shape of a sewing line and the like can be freely chosen without restriction, and further, sewing can be even dispensable. This enhances the degree of freedom in design for the appearance of the body (14).

The clothing such as shorts of the first aspect may be configured so that, as set forth in a fifth aspect of the invention, if the distance between an intersection point (J) where the back center line (S2) intersects with the inner-crotch back portion (17) and the front center line (S1) is B and the distance between the inner-crotch front portion (16) and the inner-crotch back portion (17) is C, then a ratio C/B is set to fall within a range of 0.4 to 2.5. If the ratio C/B is below 0.4, the area where the clothing envelops the buttocks is too small, while if the ratio C/B is above 2.5, the area where it envelops the buttocks is too large. This makes it impossible to set the size around the thigh portion of the clothing to desired measurements, thereby impairing the effects. Further, as a more desired range, as set forth in a sixth aspect of the invention, the ratio C/B may be set to fall within a range of 0.8 to 1.5.

The clothing such as shorts of the fifth or sixth aspect may be configured so that, as set forth in a seventh aspect of the invention, if the distance between the part nearest to the front center line (S1) of a hip hemline (15*a*) which occupies a substantially rear half of the inner periphery of the high-thigh-size formation portion (15) and the front centerline (S1) is A and the distance between an intersection point (J) where the back center line (S2) intersects with the inner-crotch back portion (17) and the front center line (S1) is B, then a ratio B/A is set to fall within a range of 1.6 to 6. If the ratio B/A is below 1.6, the area where the clothing envelops the buttocks is too small to envelop the buttocks stably. On the other hand, if the ratio B/A is above 6, then the clothing loosely narrows downward, and thereby, a three-dimensional shape is difficult to obtain. Further, as a more desired range, as set forth in an eighth aspect of the invention, the ratio B/A may be set to fall within a range of 2 to 4.

According to the invention, the girth of the portion of the clothing such as shorts corresponding to the hip lower region is narrowed down so that the hip lower portion can fit to the shape of the hip lower region. Therefore, the clothing such as shorts has advantages in that it is capable of deeply and three-dimensionally enveloping the hemispherical lower half in the hip lower region, fitting excellently to the hip lower region and thereby certainly preventing the hip hemlines from rising, and when the person is in a standing posture, producing neither loose wrinkles nor bagginess in the portion of the clothing such as shorts corresponding to the hip lower region or the gluteal groove part and thereby obtaining beautiful hip hemlines. Moreover, in forming the body into a tubular shape, there are no restrictions on the number of sewing places, the position of sewing, the shape of a sewing line and the like, thereby enhancing the degree of freedom in design for the appearance of the body.

BEST MODE FOR CARRYING OUT THE INVENTION

Preferred embodiments of the invention will be described with reference to the drawings.

Figure 1:
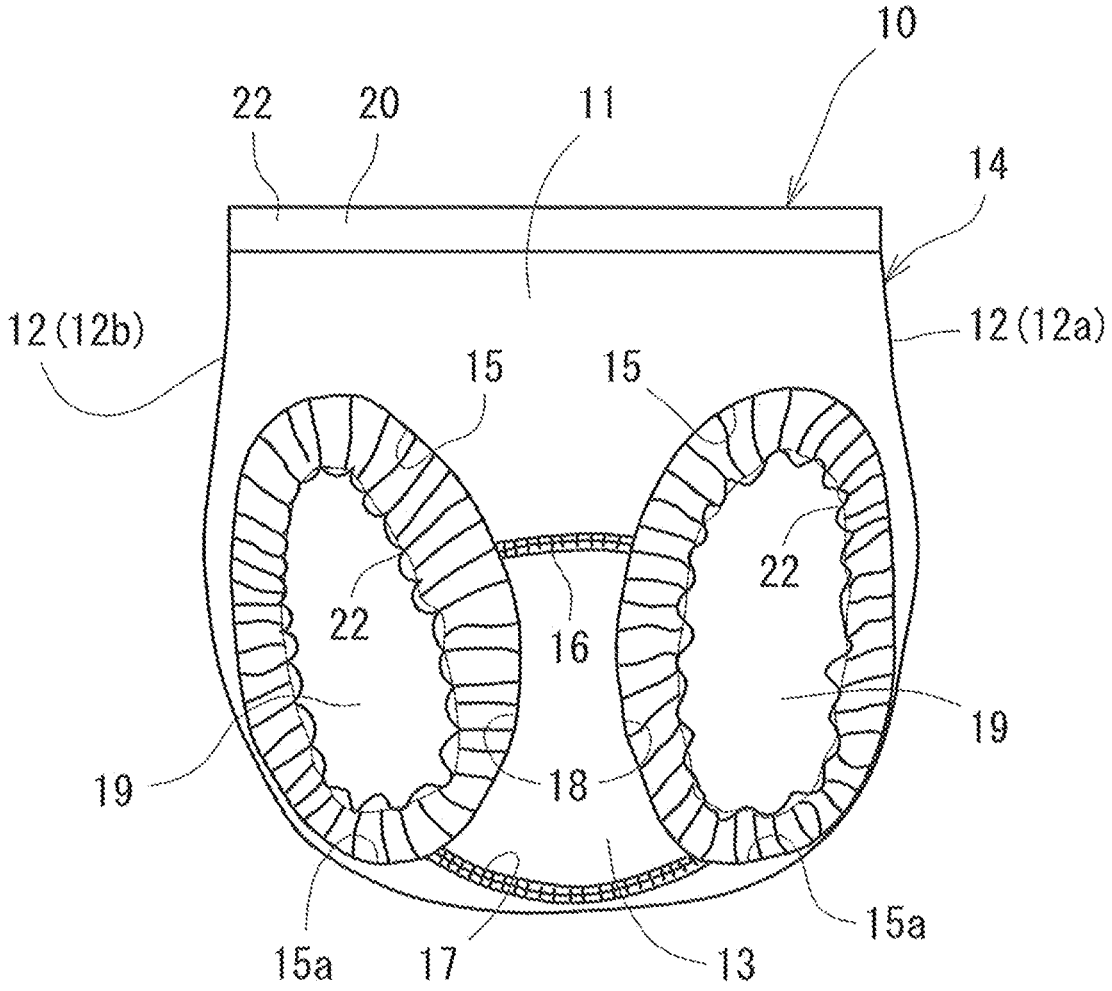
FIG. 1 is a front view of shorts of an embodiment of the invention.
Figure 2:
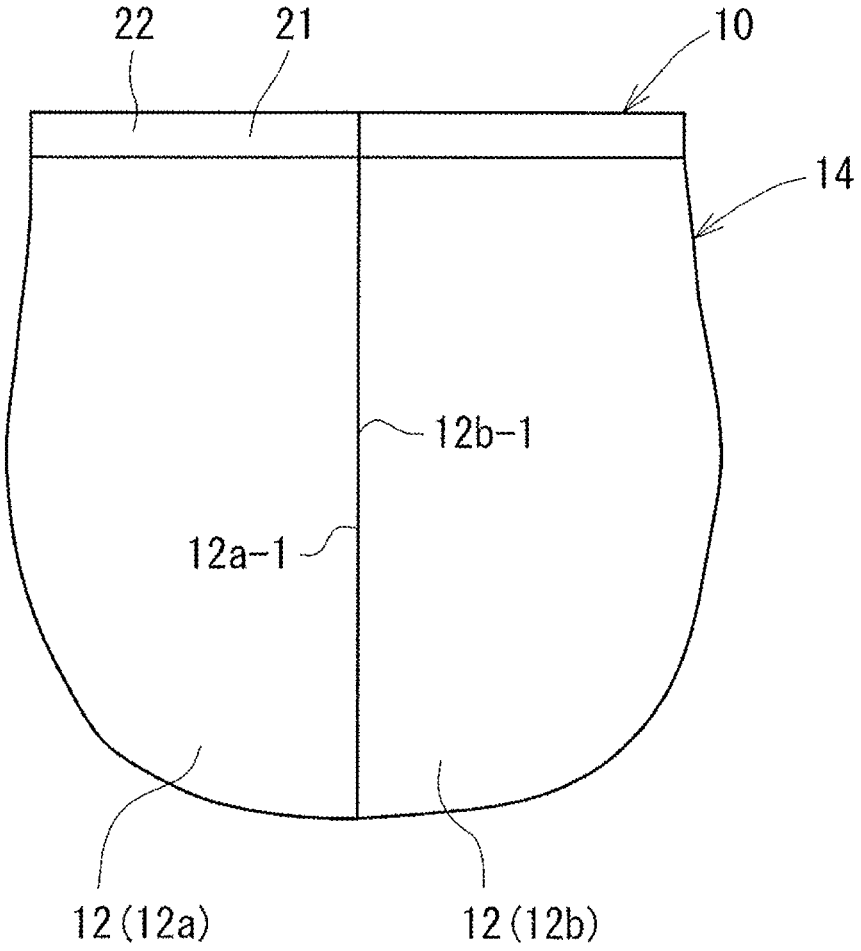
FIG. 2 is a rear view of the shorts.
Figure 3:
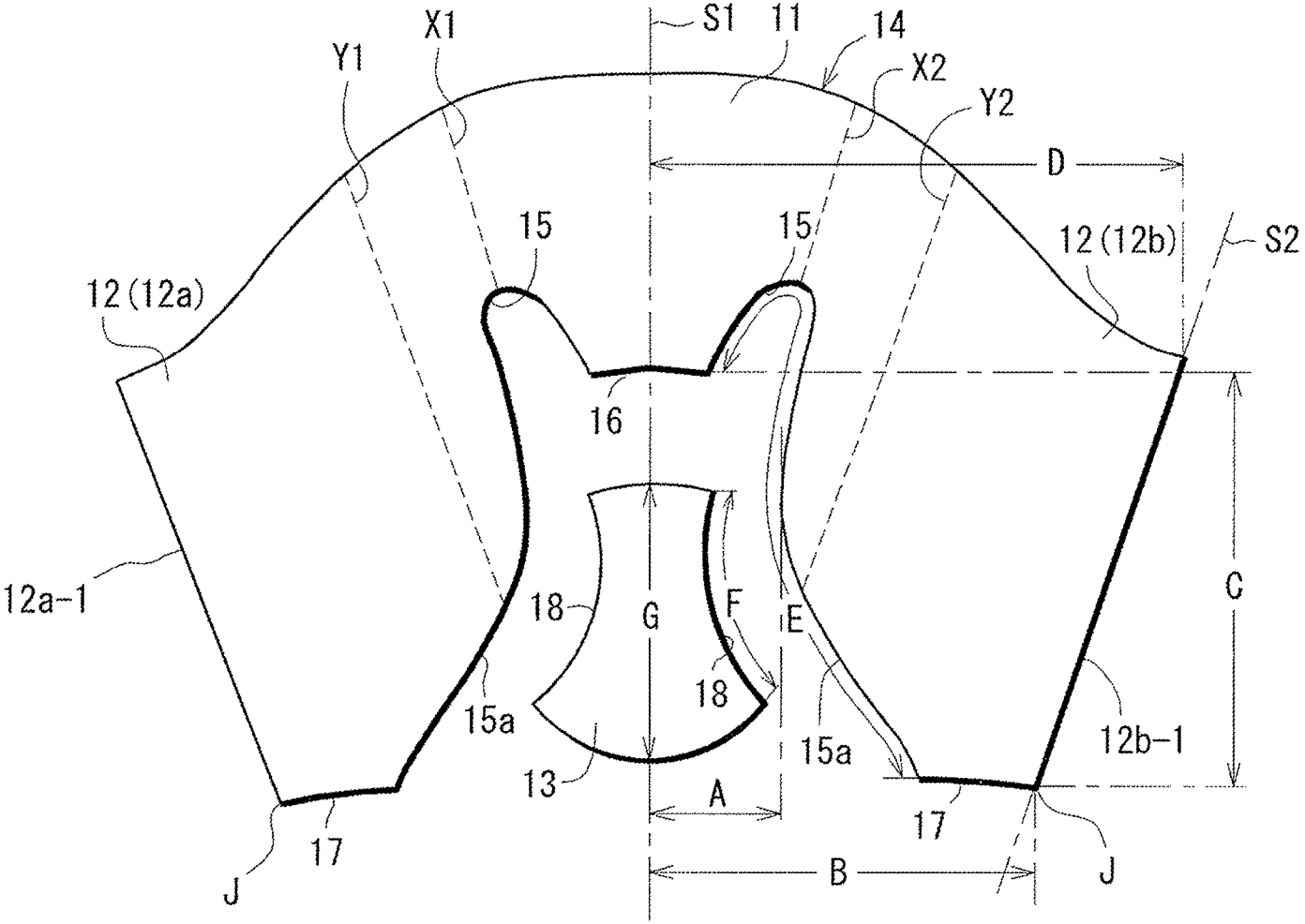
FIG. 3 is a development plan view of a body and a gusset portion of the shorts.

In FIGS. 1 to 3, shorts 10 of an embodiment of the clothing of the invention includes, as main configuring members thereof: a body 14 which has a front covering portion 11 covering the lower abdomen of a person and a back covering portion 12 united with the front covering portion 11 and covering the buttocks of the person; and a gusset portion 13 disposed between an inner-crotch front portion at the lower end of the front covering portion 11 and an inner-crotch back portion at the lower end of the back covering portion 12 and covering the crotch of the person. The front covering portion 11 and the back covering portion 12 of the body 14 and the gusset portion 13 are made of stretchable fabric.

As shown in FIG. 3, the front covering portion 11 is formed at the lower end thereof with high-thigh-size formation portions 15 which are bilaterally symmetrical and each coved upward. A hip hemline 15*a* which occupies a substantially rear half of the inner periphery of the high-thigh-size formation portion 15 is formed into a convex arcuately curved edge which protrudes toward a front center line S1 vertically running through the middle in the lateral directions of the front covering portion 11.

The front covering portion 11 is united on both left and right sides thereof with a left half 12*a* and a right half 12*b* of the back covering portion 12, respectively.

The body 14 is opened and developed along a back center line S2 vertically running through the middle in the lateral directions of the back covering portion 12, and in the developed body 14, with respect to the front center line S1 vertically running through the middle in the lateral directions of the front covering portion 11, the back center line S2 of the back covering portion 12 is set so that the downward extended line of the back center line S2 approaches the downward extended line of the front center line S1 in a downward narrowing manner. As indicated by solid lines in FIG. 3, a left edge 12*a*-1 of the left half 12*a* of the back covering portion 12 and a right edge 12*b*-1 of the right half 12*b* of the back covering portion 12 are linearly formed in a downward narrowing manner and coincide with the back center line S2 of the back covering portion 12. However, the left edge 12*a*-1 and the right edge 12*b*-1 are not limited to the linear shape. Instead of this shape, for example, a substantially lower half of the left edge 12*a*-1 and a substantially lower half of the right edge 12*b*-1 may be each formed into a gentle arcuately curved edge which is outward convex in a downward narrowing manner, so as to extend along the curved shape of the hip lower region as far as possible.

The body 14 cut out in this way is formed, as shown in FIG. 2, into a tubular shape by sewing together the left edge 12*a*-1 of the left half 12*a* of the back covering portion 12 and the right edge 12*b*-1 of the right half 12*b* of the back covering portion 12. An inner-crotch front portion 16 formed at the lower end of the front covering portion 11 and an inner-crotch back portion 17 formed at the lower end of each of the left half 12*a* and the right half 12*b* of the back covering portion 12 are connected to each other by the gusset portion 13. Consequently, as shown in FIG. 1, right and left leg openings 19 are formed by the right and left high-thigh-size formation portions 15 and right and left edges 18 of the gusset portion 13, respectively.

A stretchable strip-like material 22 such as a stretch lace, a fabric and a rubber, which is slightly wide (if it is a narrow type, the effect is reduced), is sewn to each of waist portions 20, 21 of the front covering portion 11 and the back covering portion 12 of the body 14 respectively and the peripheries of the leg openings 19.

In the thus sewn shorts 10, the body 14 is opened and developed along the back center line S2 of the back covering portion 12, and in the developed body 14, with respect to the front center line S1 of the front covering portion 11, the back center line S2 of the back covering portion 12 is set so that the downward extended line of the back center line S2 approaches the downward extended line of the front center line S1 in a downward narrowing manner. Therefore, the body 14 is formed into a tubular shape so that the vicinity of the hip hem can be three-dimensionally narrowed down in a non-worn state. As a result, in a worn state, the body 14 fits to the shape of the hip lower region and the hip hemlines 15*a* fit to the gluteal groove part of the hips, so that the body 14 can envelop the hip lower region deeply and sufficiently. Accordingly, when the person changes from a standing posture and sits on a chair, bends at the waist or takes a crouching posture or the like, the hip hemlines 15*a* can be surely prevented from rising. In addition, when the person is in a standing posture, neither loose wrinkles nor bagginess is produced in the portion of the clothing such as shorts corresponding to the hip lower region or the gluteal groove part, thereby obtaining beautiful hip hemlines.

In the above developed form, with respect to the front center line S1 of the front covering portion 11, the back center line S2 of the back covering portion 12 is set so that the downward extended line of the back center line S2 approaches the downward extended line of the front center line S1 in a downward narrowing manner, and hence, the measurements of the buttock portion and around the thigh portion of the shorts 10 are secured in biased directions. However, the front covering portion 11, the back covering portion 12 and the gusset portion 13 are made of stretchable fabric, thereby enabling the person to wear the shorts 10 without any trouble.

In FIG. 3, if a distance A (the distance between the part nearest to the front center line S1 of the hip hemline 15*a* and the front center line S1; the same below) is shortened and a distance C (the distance between the inner-crotch front portion 16 and the inner-crotch back portion 17; the same below) is lengthened, then the effect of enveloping the buttocks from aside can be obtained. A distance B (the distance between an intersection point J where the back center line S2 intersects with the inner-crotch back portion 17 and the front center line S1; the same below) may be preferably lengthened to secure volume enough to envelop the buttocks. However, if the distance B is too long, then the back center lines S2 less narrow downward with respect to the front center line S1, and thereby, a three-dimensional shape is difficult to obtain.

Therefore, a predetermined high-thigh size is decided, and next, it is necessary to obtain an ideal pattern in consideration of the above distances A, B, C.

Specifically, if the ratio B/A is low, the area where the shorts 10 envelop the buttocks is too small to envelop the buttocks stably. On the other hand, if the ratio B/A is too high, then the shorts 10 loosely narrow downward, and thereby, a three-dimensional shape is difficult to obtain. Taking this into account, the ratio B/A may be set to fall within a range of 1.6 to 6, more preferably 2 to 4.

Further, if the ratio C/B is too low, then in the same manner as the case where the ratio B/A is low, the area where the shorts 10 envelop the buttocks is too small. On the other hand, if the ratio C/B is too high, the area where they envelop the buttocks is too large. This makes it impossible to set the size around the thigh portion of the shorts 10 to desired measurements, thereby impairing the effects. Taking this into account, the ratio C/B may be set to fall within a range of 0.4 to 2.5, more preferably 0.8 to 1.5.

Concretely, as an example of the measurements, the distance A is dimensioned to 7 cm, the distance B is dimensioned to 18 cm, the distance C is dimensioned to 20 cm, a distance D (the distance between the uppermost end of the left edge 12*a*-1 of the back covering portion 12 and the front center line S1 of the front covering portion 11, the distance between the uppermost end of the right edge 12*b*-1 of the back covering portion 12 and the front center line S1 of the front covering portion 11; the same below) is dimensioned to 25 cm, a length E (the full length of the high-thigh-size formation portion 15) is dimensioned to 33 cm, a length F (the length of the left edge 18, the length of the right edge 18 of the gusset portion 13) is dimensioned to 12 cm and a length G (the vertical length of the middle of the gusset portion 13) is dimensioned to 14 cm.

In the embodiment, the body (14) shown in FIG. 3 has the left half and the right half of the back covering portion (12) united with the front covering portion (11) on both left and right sides thereof respectively and is formed into a tubular shape by sewing together the left edge of the left half of the back covering portion (12) and the right edge of the right half of the back covering portion (12). However, the invention is not limited to this and may be configured as follows.

In addition to the place of the back center line (S2) of the back covering portion (12), the body (14) may be sewn at the place of the front center line (S1) of the front covering portion (11), or alternatively, as indicated by the broken lines of FIG. 3, at the places on both left and right sides (X1, X2, or Y1, Y2) of the front covering portion (11) or another suitable place.

In sum, the body (14) may be sewn at least at one place (S1, X1, X2, Y1, Y2) in the peripheral directions thereof, in addition to the place of the back center line (S2) of the back covering portion (12), and the body (14) is opened and developed along the back center line (S2) of the back covering portion (12) and in the developed body (14), the back center line (S2) of the back covering portion (12) may be set with respect to the front center line (S1) of the front covering portion (11) so that the downward extended line of the back center line (S2) approaches the downward extended line of the front center line (S1) in a downward narrowing manner.

Figure 4:
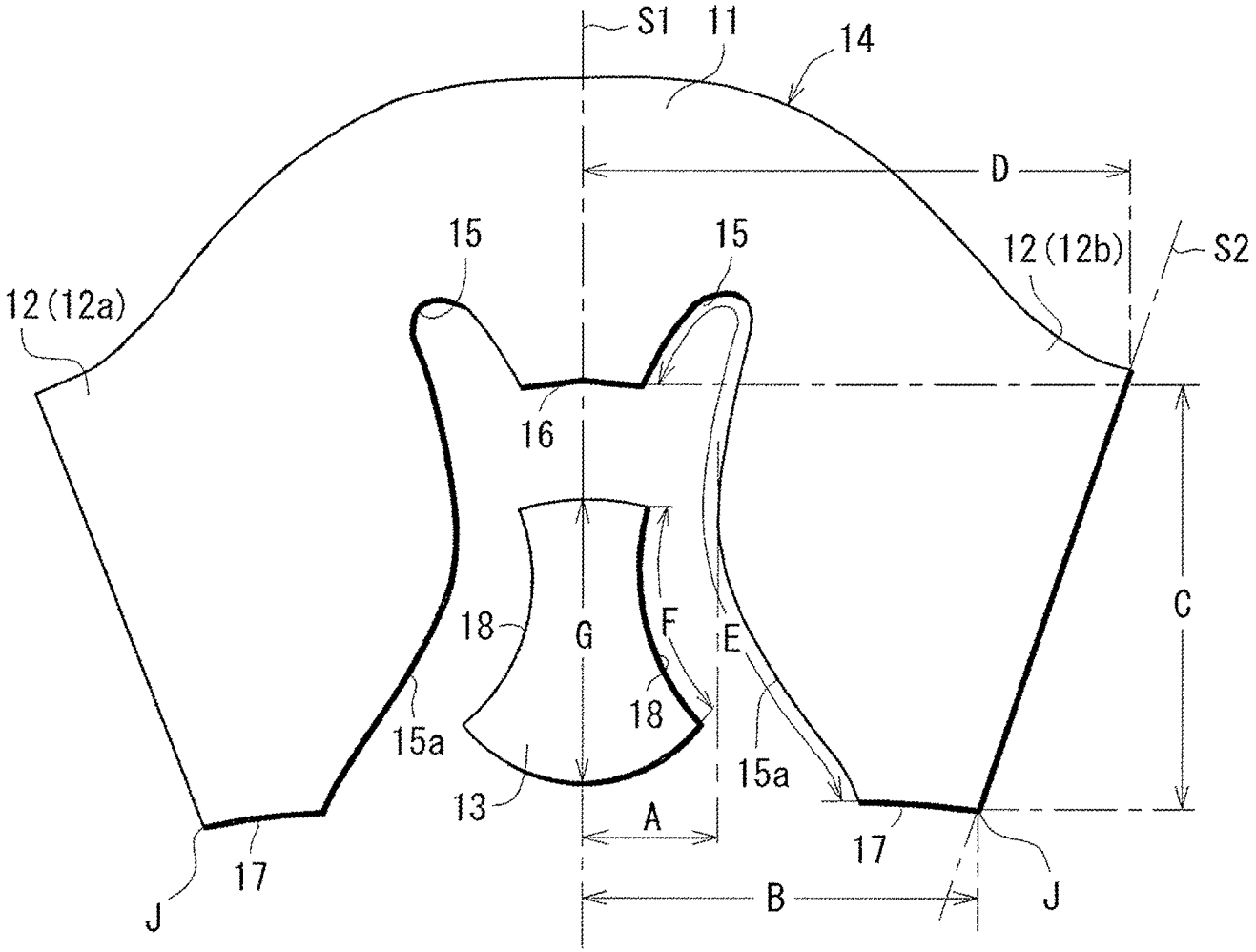
FIG. 4 is a development plan view of a body and a gusset portion, opened along a back centerline S2 of a back covering portion 12, of pants of another embodiment of the invention.

Furthermore, the clothing as the target of the invention is not limited to the body (14) shown in FIG. 3 and may be the body (14) shown in FIG. 4.

Figure 5:
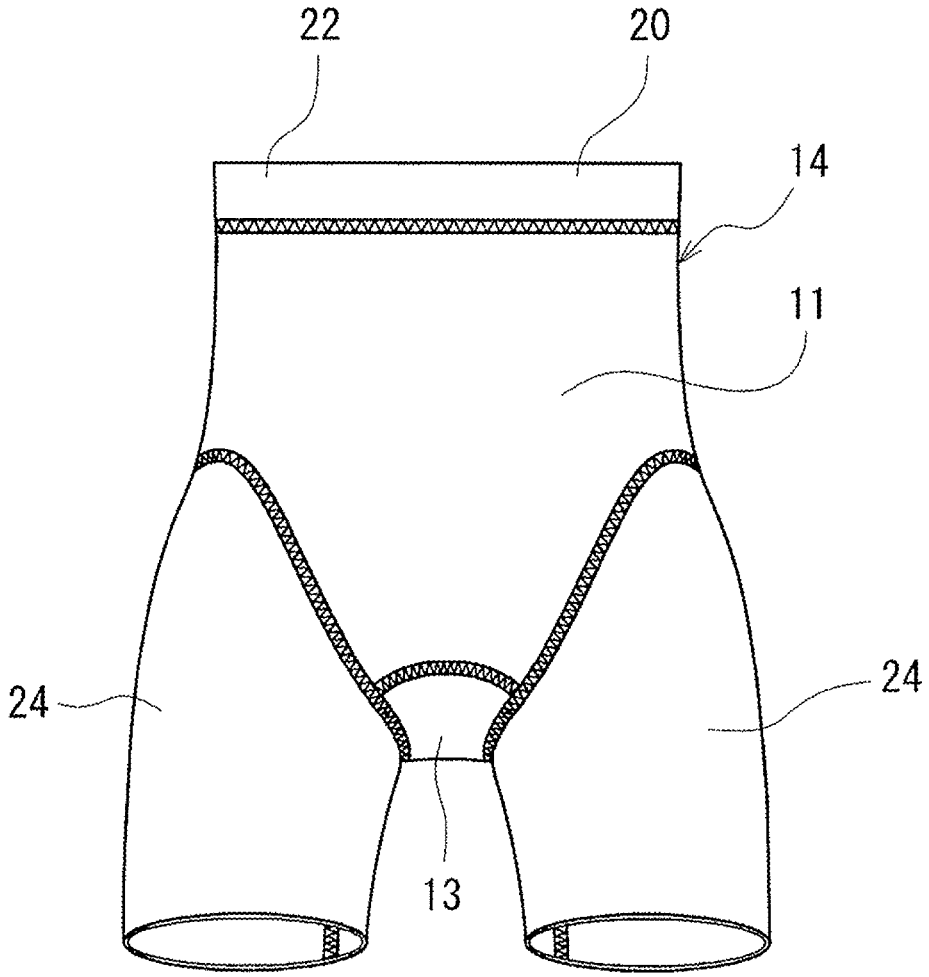
FIG. 5 is a front view of the pants of FIG. 4.
Figure 6:
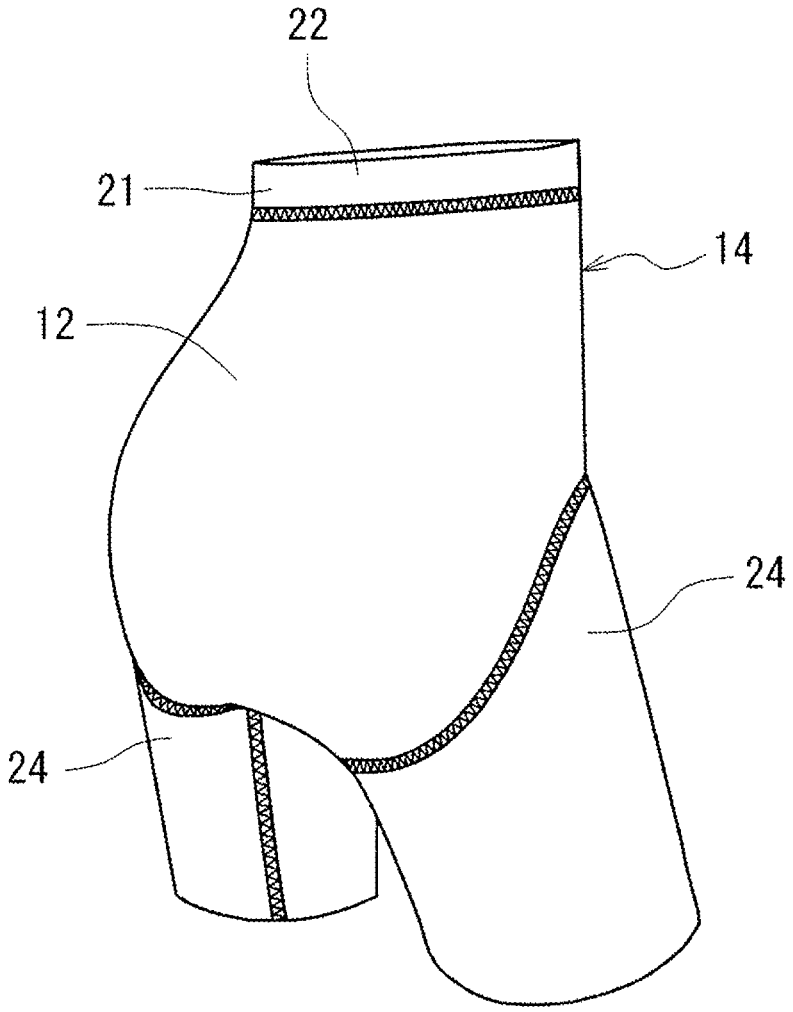
FIG. 6 is a rear perspective view of the pants of FIG. 4.

Specifically, the body (14) of FIG. 4 has the back covering portion (12) united with the front covering portion (11) on both left and right sides thereof, and hence, as shown in FIGS. 5 and 6, it may be a body formed into a tubular shape without a sewing place.

Even this body (14) has the same operation and effects as the shorts of FIGS. 1 to 3, as shown in FIG. 4, as long as the body (14) is opened and developed along the back center line (S2) of the back covering portion (12) and in the developed body (14), the back center line (S2) of the back covering portion (12) is set with respect to the front center line (S1) of the front covering portion (11) so that the downward extended line of the back center line (S2) approaches the downward extended line of the front center line (S1) in a downward narrowing manner (the pants shown in FIGS. 5 and 6 are configured so that each of thigh covering portions 24 can be sewn thereto).

Moreover, in the clothing as the target of the invention, the gusset portion 13 may be continuous and united with either or both of the front covering portion 11 and the back covering portion 12. Alternatively, if the front covering portion (11) is united with the back covering portion (12), the gusset portion 13 may also be continuous and united with the front covering portion 11 and the back covering portion 12.

Figure 7:
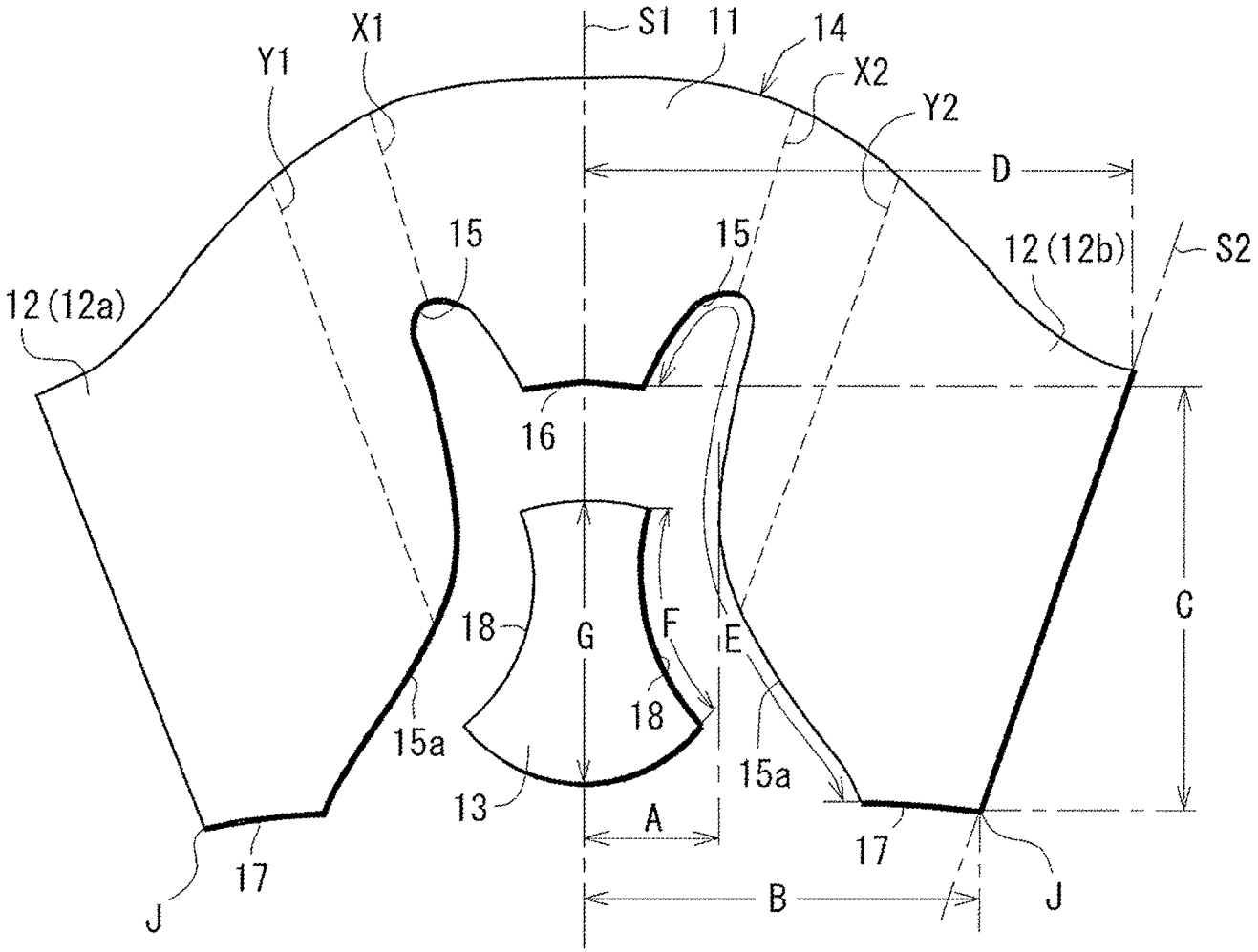
FIG. 7 is a development plan view of pants of another embodiment of the invention.
Figure 8:
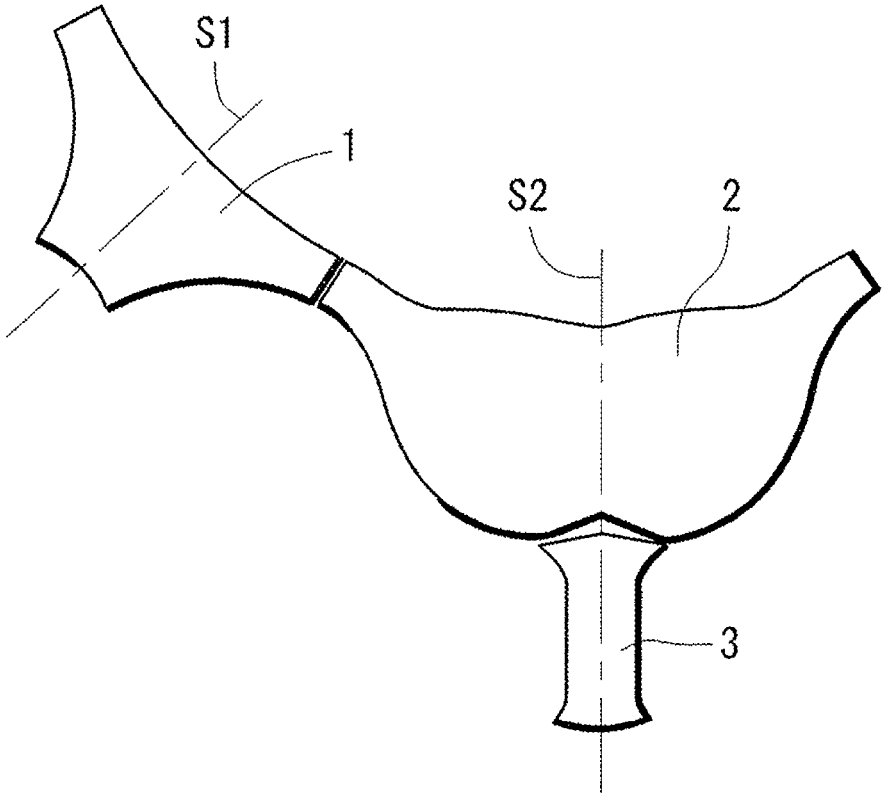
Fig. 8 Prior Art
FIG. 8 is a development plan view of a front body, aback body and a gusset portion of panties of a conventional art example.
Figure 9:
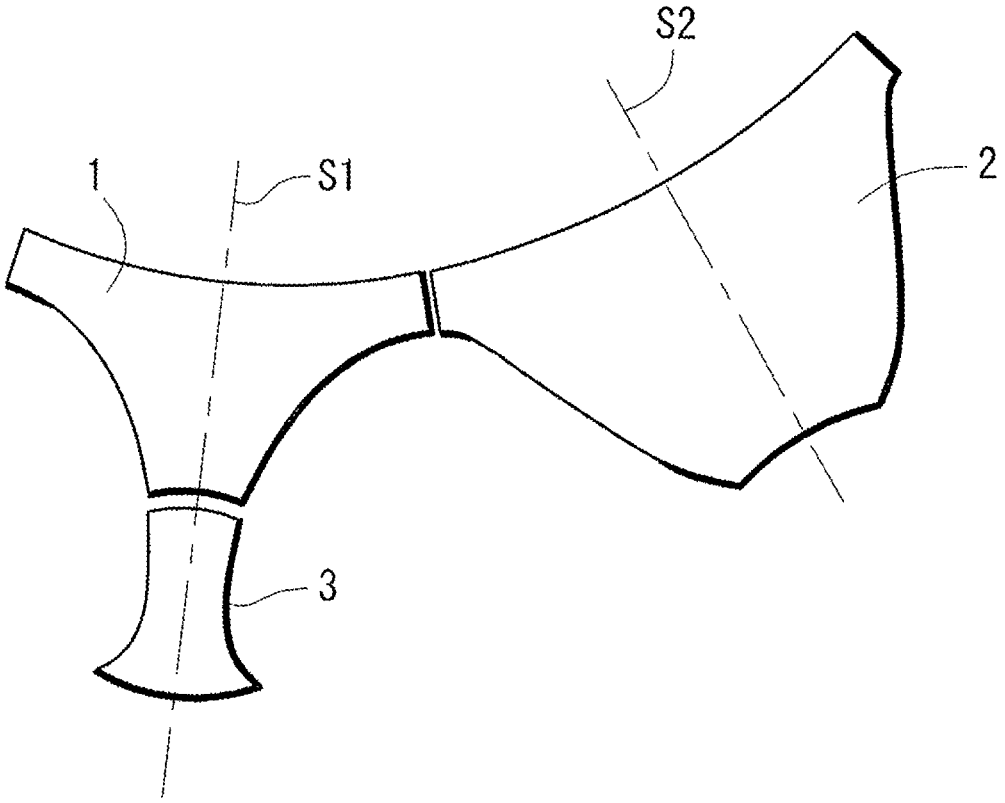
Fig. 9 Prior Art
FIG. 9 is a development plan view of a front body, a back body and a gusset portion of shorts of another conventional art example.
Figure 10:
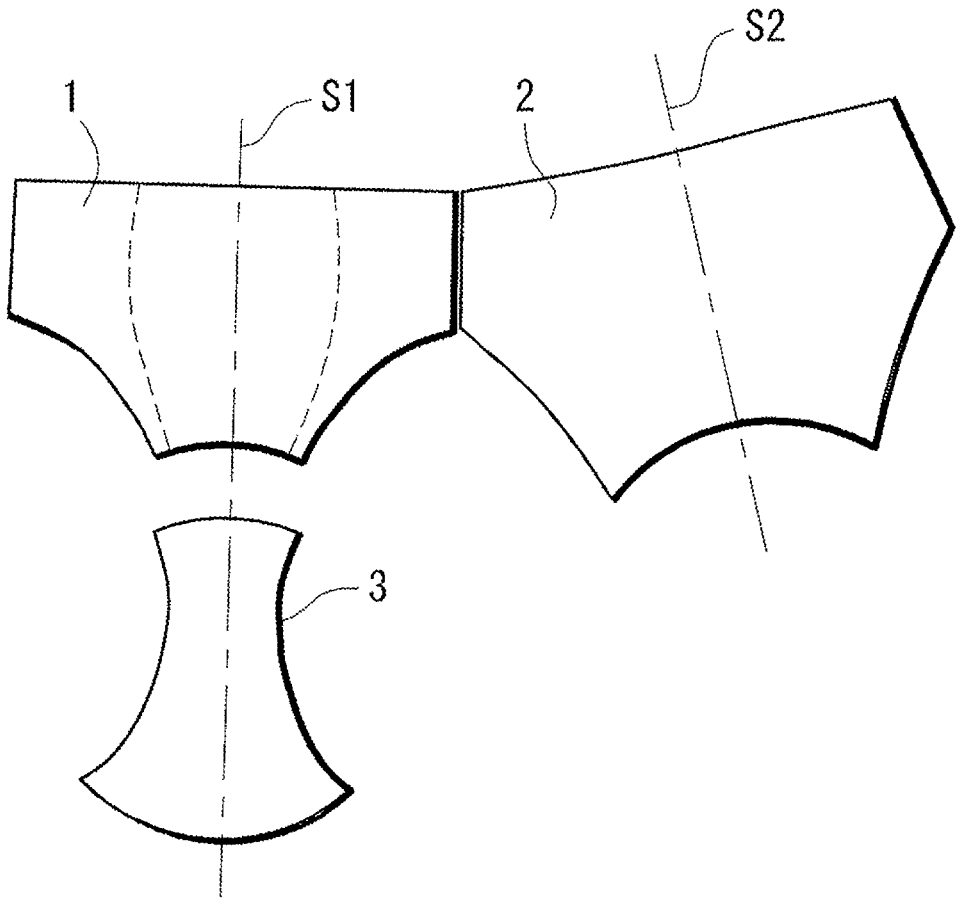
Fig. 10 Prior Art
FIG. 10 is a development plan view of a front body, a back body and a gusset portion of shorts of still another conventional art example.
Figure 11:
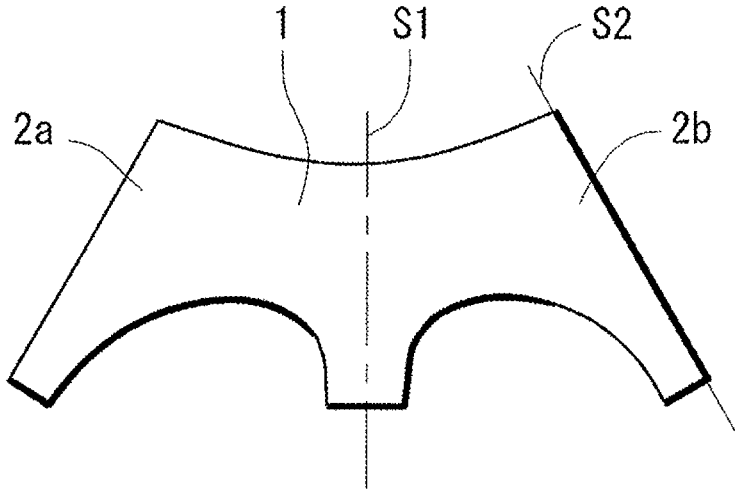
Fig. 11 Prior Art
FIG. 11 is a development plan view of a body in which a front body is united with a back body of shorts of still another conventional art example.

In addition, the clothing as the target of the invention is not limited to the body (14) shown in FIG. 3 and may be the body (14) shown in FIG. 7.

Specifically, the body (14) may be a body which is united at the place of the back center line (S2) of the back covering portion (12) and which is sewn up, except for the back center line (S2), at the place of the front center line (S1), or alternatively, as indicated by the broken lines of FIG. 7, at the places on both left and right sides (X1, X2, or Y1, Y2) of the front covering portion (11) or another suitable place.

In sum, the body (14) may be sewn at least at one place in the peripheral directions thereof which is other than the place of the back center line (S2) of the back covering portion (12), and the body (14) is opened and developed along the back center line (S2) of the back covering portion (12) and in the developed body (14), the back center line (S2) of the back covering portion (12) may be set with respect to the front center line (S1) of the front covering portion (11) so that the downward extended line of the back center line (S2) approaches the downward extended line of the front center line (S1) in a downward narrowing manner.

Furthermore, in terms of the body (14) of the clothing as the target of the invention, in order to prevent bagginess in the body (14) and neaten the appearance and design thereof on the sides of the waist portions (20, 21) shown in FIGS. 1, 2, 5 and 6, the body (14) is opened and developed along the back center line (S2) of the back covering portion (12) and in the developed form, the body (14) may be shaped so that the portion thereof on the upper side of the back center line (S2) contracts toward the front center line (S1).

Moreover, the clothing as the target of the invention may be similarly applied to a bathing suit, a leotard, tights for men or ladies, briefs for men or the like. Still further, the body 14 may also be provided with darts.

What is claimed is:

1. Shorts, comprising:

a tubular body (14) including a stretchable front covering portion (11) and a stretchable back covering portion (12), the front covering portion (11) having high-thigh-size formation portions (15) which are bilaterally symmetrical and each coved upward in a lower end of the front covering portion (11); and a gusset portion (13) disposed between an inner-crotch front portion (16) at the lower end of the front covering portion (11) and an inner-crotch back portion (17) at a lower end of the back covering portion (12), wherein the body (14) includes a left half (12*a*) and a right half (12*b*) of the back covering portion (12) on left and right sides respectively of the front covering portion (11), and a sewing part in which an edge of the left half (12*a*) of the back covering portion (12) and an edge of the right half (12*b*) of the back covering portion (12) are sewn, and wherein in a development plan view of the body (14) in which the body (14) is opened along a back center line (S2) vertically running through a middle in a lateral direction of the back covering portion (12), the back center line (S2) is extended from a vicinity of an upper end of the back center line (S2), which corresponds to an upper end of the back covering portion (12), to a lower end of the back center line (S2), which corresponds to the lower end of the back covering portion (12), in a downward narrowing manner with respect to a front center line (S1) vertically running through the middle in the lateral directions of the front covering portion (11) so that a downward extension of the back center line (S2) approaches a downward extension of the front center line (S1).

2. The shorts according to claim 1, wherein in a developed condition of the body (14), a distance between an intersection point (J) where the back center line (S2) intersects with the inner-crotch back portion (17) and the front center line (S1) is B and a distance between the inner-crotch front portion (16) and the inner-crotch back portion (17) is C, and a ratio C/B is set to fall within a range of 0.4 to 2.5.

3. The shorts according to claim 1, wherein in a developed condition of the body (14), a distance between an intersection point (J) where the back center line (S2) intersects with the inner-crotch back portion (17) and the front center line (S1) is B and a distance between the inner-crotch front portion (16) and the inner-crotch back portion (17) is C, and a ratio C/B is set to fall within a range of 0.8 to 1.5.

4. The shorts according to claim 1, wherein in a developed condition of the body (14), a distance between a part nearest to the front center line (S1) of a hip hemline (15*a*) on an inner periphery of each high-thigh-size formation portion (15) and the front center line (S1) is A and a distance between an intersection point (J) where the back center line (S2) intersects with the inner-crotch back portion (17) and the front center line (S1) is B, and a ratio B/A is set to fall within a range of 1.6 to 6.

5. The shorts according to claim 1, wherein in a developed condition of the body (14), a distance between a part nearest to the front center line (S1) of a hip hemline (15*a*) on an inner periphery of each high-thigh-size formation portion (15) and the front center line (S1) is A and a distance between an intersection point (J) where the back center line (S2) intersects with the inner-crotch back portion (17) and the front center line (S1) is B, and a ratio B/A is set to fall within a range of 2 to 4.

6. Shorts, comprising:

a tubular body (14) including a stretchable front covering portion (11) and a stretchable back covering portion (12), the front covering portion (11) having high-thigh-size formation portions (15) which are bilaterally symmetrical and each coved upward in a lower end of the front covering portion (11); and a gusset portion (13) disposed between an inner-crotch front portion (16) at the lower end of the front covering portion (11) and an inner-crotch back portion (17) at a lower end of the back covering portion (12), wherein the body (14) includes at least one sewing part which is provided at least at one place (S1, X1, X2, Y1, Y2) in the peripheral directions of the body (14), in addition to the place of a back center line (S2) vertically running through the middle in the lateral directions of the back covering portion (12), and wherein in a development plan view of the body (14) in which the body (14) is opened along the back center line (S2), the back center line (S2) is extended from a vicinity of an upper end of the back center line (S2), which corresponds to an upper end of the back covering portion (12), to a lower end of the back center line (S2), which corresponds to the lower end of the back covering portion (12), in a downward narrowing manner with respect to a front center line (S1) vertically running through the middle in the lateral directions of the front covering portion (11) so that a downward extension of the back center line (S2) approaches a downward extension of the front center line (S1).

7. The shorts according to claim 6, in a developed condition of the body (14), a distance between an intersection point (J) where the back center line (S2) intersects with the inner-crotch back portion (17) and the front center line (S1) is B and a distance between the inner-crotch front portion (16) and the inner-crotch back portion (17) is C, and a ratio C/B is set to fall within a range of 0.4 to 2.5.

8. The shorts according to claim 6, in a developed condition of the body (14), a distance between an intersection point (J) where the back center line (S2) intersects with the inner-crotch back portion (17) and the front center line (S1) is B and a distance between the inner-crotch front portion (16) and the inner-crotch back portion (17) is C, and a ratio C/B is set to fall within a range of 0.8 to 1.5.

9. The shorts according to claim 6, in a developed condition of the body (14), a the distance between the part nearest to the front center line (S1) of a hip hemline (15*a*) on the inner periphery of each high-thigh-size formation portion (15) and the front center line (S1) is A and a distance between an intersection point (J) where the back center line (S2) intersects with the inner-crotch back portion (17) and the front center line (S1) is B, and a ratio B/A is set to fall within a range of 1.6 to 6.

10. The shorts according to claim 6, wherein in a developed condition of the body (14), a distance between the part nearest to the front center line (S1) of a hip hemline (15*a*) on the inner periphery of each high-thigh-size formation portion (15) and the front center line (S1) is A and a distance between an intersection point (J) where the back center line (S2) intersects with the inner-crotch back portion (17) and the front center line (S1) is B, and a ratio B/A is set to fall within a range of 2 to 4.

11. Shorts, comprising:

a tubular body (14) including a stretchable front covering portion (11) and a stretchable back covering portion (12), the front covering portion (11) having high-thigh-size formation portions (15) which are bilaterally symmetrical and each coved upward in a lower end of the front covering portion (11); and a gusset portion (13) disposed between an inner-crotch front portion (16) at the lower end of the front covering portion (11) and an inner-crotch back portion (17) at a lower end of the back covering portion (12), wherein the body (14) includes the back covering portion (12) which is united continuously with the front covering portion (11) on both left and right sides of the front covering portion (11), and wherein in a development plan view of the body (14) in which the body (14) is opened along a back center line (S2) vertically running through a middle in a lateral direction of the back covering portion (12), the back center line (S2) is extended from a vicinity of an upper end of the back center line (S2), which corresponds to an upper end of the back covering portion (12), to a lower end of the back center line (S2), which corresponds to the lower end of the back covering portion (12), in a downward narrowing manner with respect to a front center line (S1) vertically running through the middle in the lateral directions of the front covering portion (11) so that a downward extension of the back center line (S2) approaches a downward extension of the front center line (S1).

12. The shorts according to claim 11, in a developed condition of the body (14), a distance between an intersection point (J) where the back center line (S2) intersects with the inner-crotch back portion (17) and the front center line (S1) is B and a distance between the inner-crotch front portion (16) and the inner-crotch back portion (17) is C, and a ratio C/B is set to fall within a range of 0.4 to 2.5.

13. The shorts according to claim 11, wherein in a developed condition of the body (14), a distance between an intersection point (J) where the back center line (S2) intersects with the inner-crotch back portion (17) and the front center line (S1) is B and a distance between the inner-crotch front portion (16) and the inner-crotch back portion (17) is C, and a ratio C/B is set to fall within a range of 0.8 to 1.5.

14. The shorts according to claim 11, wherein in a developed condition of the body (14), a distance between the part nearest to the front center line (S1) of a hip hemline (15*a*) on the inner periphery of each high-thigh-size formation portion (15) and the front center line (S1) is A and a distance between an intersection point (J) where the back center line (S2) intersects with the inner-crotch back portion (17) and the front center line (S1) is B, and a ratio B/A is set to fall within a range of 1.6 to 6.

15. The shorts according to claim 11, wherein in a developed condition of the body (14), a distance between the part nearest to the front center line (S1) of a hip hemline (15*a*) on the inner periphery of each high-thigh-size formation portion (15) and the front center line (S1) is A and a distance between an intersection point (J) where the back center line (S2) intersects with the inner-crotch back portion (17) and the front center line (S1) is B, and a ratio B/A is set to fall within a range of 2 to 4.

16. Shorts, comprising:

a tubular body (14) including a stretchable front covering portion (11) and a stretchable back covering portion (12), the front covering portion (11) having high-thigh-size formation portions (15) which are bilaterally symmetrical and each coved upward in a lower end of the front covering portion (11); and a gusset portion (13) disposed between an inner-crotch front portion (16) at the lower end of the front covering portion (11) and an inner-crotch back portion (17) at a lower end of the back covering portion (12), wherein the body (14) includes at least one sewing part which is provided at least at one place (S1, X1, X2, Y1, Y2) in the peripheral directions of the body (14) which is other than a back center line (S2) vertically running through the middle in the lateral directions of the back covering portion (12), and wherein in a development plan view of the body (14) in which the body (14) is opened along the back center line (S2), the back center line (S2) is extended from a vicinity of an upper end of the back center line (S2), which corresponds to an upper end of the back covering portion (12), to a lower end of the back center line (S2), which corresponds to the lower end of the back covering portion (12), in a downward narrowing manner with respect to a front center line (S1) vertically running through the middle in the lateral directions of the front covering portion (11) so that a downward extension of the back center line (S2) approaches a downward extension of the front center line (S1).

17. The shorts according to claim 16, in a developed condition of the body (14), a distance between an intersection point (J) where the back center line (S2) intersects with the inner-crotch back portion (17) and the front center line (S1) is B and a distance between the inner-crotch front portion (16) and the inner-crotch back portion (17) is C, and a ratio C/B is set to fall within a range of 0.4 to 2.5.

18. The shorts according to claim 16, in a developed condition of the body (14), a distance between an intersection point (J) where the back center line (S2) intersects with the inner-crotch back portion (17) and the front center line (S1) is B and a distance between the inner-crotch front portion (16) and the inner-crotch back portion (17) is C, and a ratio C/B is set to fall within a range of 0.8 to 1.5.

19. The shorts according to claim 16, wherein in a developed condition of the body (14), a distance between the part nearest to the front center line (S1) of a hip hemline (15*a*) on the inner periphery of each high-thigh-size formation portion (15) and the front center line (S1) is A and a distance between an intersection point (J) where the back center line (S2) intersects with the inner-crotch back portion (17) and the front center line (S1) is B, and a ratio B/A is set to fall within a range of 1.6 to 6.

20. The shorts according to claim 16, wherein in a developed condition of the body (14), a distance between the part nearest to the front center line (S1) of a hip hemline (15*a*) on the inner periphery of each high-thigh-size formation portion (15) and the front center line (S1) is A and a distance between an intersection point (J) where the back center line (S2) intersects with the inner-crotch back portion (17) and the front center line (S1) is B, and a ratio B/A is set to fall within a range of 2 to 4.

* * * * *